US009016031B2

(12) United States Patent
Chubb et al.

(10) Patent No.: US 9,016,031 B2
(45) Date of Patent: Apr. 28, 2015

(54) DOOR FOR A REFRIGERATED CABINET

(71) Applicants: Richard Chubb, Voorhees, NJ (US); Ralph Wearsch, Huntersville, NC (US)

(72) Inventors: Richard Chubb, Voorhees, NJ (US); Ralph Wearsch, Huntersville, NC (US)

(73) Assignee: Thermoseal Industries, L.L.C., Gloucester, NJ (US)

( * ) Notice: Subject to any disclaimer, the term of this patent is extended or adjusted under 35 U.S.C. 154(b) by 0 days.

(21) Appl. No.: 14/493,747

(22) Filed: Sep. 23, 2014

(65) Prior Publication Data

US 2015/0020451 A1 Jan. 22, 2015

Related U.S. Application Data

(62) Division of application No. 13/792,864, filed on Mar. 11, 2013, now Pat. No. 8,869,493.

(51) Int. Cl.

| | |
|---|---|
| ***F25D 19/00*** | (2006.01) |
| ***F25D 23/02*** | (2006.01) |
| ***E06B 7/16*** | (2006.01) |
| ***E06B 3/66*** | (2006.01) |
| ***A47F 3/04*** | (2006.01) |
| *E06B 3/263* | (2006.01) |
| *F25D 23/08* | (2006.01) |

(52) U.S. Cl.

CPC . *F25D 23/02* (2013.01); *E06B 7/16* (2013.01); *E06B 3/6617* (2013.01); *A47F 3/043* (2013.01); *E06B 3/26341* (2013.01); *F25D 23/028* (2013.01); *F25D 23/087* (2013.01); *F25D 2201/00* (2013.01)

(58) Field of Classification Search

CPC ..... A47F 3/043; A47F 3/0434; A47F 3/125; E06B 3/66366; E06B 3/6621; E06B 3/6617; E06B 3/663304; Y02B 80/24; F25D 23/02; F25D 23/028

USPC ..... 52/656.4, 786.1, 786.11, 784.1, 786.13, 52/204.593, 204.6; 312/138.1, 116; 62/449, 264; 49/501, 504, 386, 70, 49/478.1; 428/34

See application file for complete search history.

(56) References Cited

U.S. PATENT DOCUMENTS

| | | | | |
|---|---|---|---|---|
| 3,499,245 | A * | 3/1970 | Richter et al. | 49/70 |
| 3,629,972 | A * | 12/1971 | Rehberg et al. | 49/240 |
| 4,223,482 | A * | 9/1980 | Barroero et al. | 49/386 |
| 4,248,489 | A * | 2/1981 | Barroero et al. | 312/296 |
| 4,998,382 | A * | 3/1991 | Kostos et al. | 49/501 |
| 5,024,023 | A * | 6/1991 | Kostos et al. | 49/501 |
| 5,111,618 | A * | 5/1992 | Kaspar et al. | 49/501 |
| 5,255,473 | A * | 10/1993 | Kaspar et al. | 49/501 |
| 6,029,411 | A * | 2/2000 | Richardson | 52/204.51 |
| 6,260,255 | B1 * | 7/2001 | Richardson et al. | 29/458 |
| 6,886,297 | B1 * | 5/2005 | Crandell | 52/172 |
| 7,043,886 | B1 * | 5/2006 | Chubb | 52/656.4 |
| 2002/0056184 | A1 * | 5/2002 | Richardson et al. | 29/458 |
| 2003/0197449 | A1 * | 10/2003 | Cording | 312/138.1 |

(Continued)

*Primary Examiner* — Robert Canfield
*Assistant Examiner* — Babajide Demuren
(74) *Attorney, Agent, or Firm* — Francis C. Hand; Carella, Byrne, et al

(57) ABSTRACT

The door is made with a triple-lite insulated glass unit and a frame of aluminum rails. The insulated glass unit has a stepped cross-section with the outer glass lite being larger than the inner glass lites. An opaque non-conductive ceramic frit forms a rectangularly shaped border to mask the mounting of the inner glass lite(s). An electrically conductive coating on the outer glass lite is insulated from the aluminum rails of the frame by a plastic strip disposed between the outer glass lite and each rail.

10 Claims, 10 Drawing Sheets

(56) References Cited

U.S. PATENT DOCUMENTS

2005/0202178 A1* 9/2005 Roche et al. ..... 427/385.5
2006/0260229 A1* 11/2006 McKinlay et al. ..... 52/204.593
2008/0093957 A1* 4/2008 Neumann et al. ..... 312/116
2008/0122324 A1* 5/2008 Bienick ..... 312/116
2009/0308094 A1* 12/2009 Gorz et al. ..... 62/264

* cited by examiner

DOOR FOR A REFRIGERATED CABINET

This application claims the benefit of Provisional Patent Application 61/610,705, filed Mar. 14, 2012 and is a Division of U.S. Ser. No. 13/792,864, filed Mar. 11, 2013.

This invention relates to a door for a refrigerated cabinet.

As is known various types of doors have been provided for mounting on refrigerated cabinets. In some cases, the doors have been provided with glass units over a substantial portion of the front of the doors to permit easy viewing of the contents of the cabinets. For example, U.S. Pat. No. 7,043,886 provides a door assembly for commercial refrigerators and freezers that includes an insulated glass unit made up of two or more glass panes maintained in spaced-apart relation by tubular spacers with the interior between the panes appropriately sealed.

Because insulated glass doors are relatively heavy and require a sturdy and rigid frame for supporting their weight and for withstanding abusive repeated openings and closings that occur in commercial establishments, the glass unit is supported within a relatively rigid outer metallic frame, commonly formed from aluminum extrusions, with the metal frame overlapping the periphery of the glass unit for retaining the glass unit in position and for providing a decorative finished appearance to the door assembly. While improvements in energy efficiencies, structural rigidity, and mounting of such door assemblies have taken place over the years, such insulated glass door assemblies have remained substantially unchanged.

U.S. Pat. No. 6,148,563 describes a reach-in door having a finished molded door frame of a suitable material, such as a reaction injection molded polyurethane, that does not require a metal frame or covering of any type.

Other types of reach-in doors use heavy, bulky structural extrusions to accomplish a full-perimeter door framing system—these are typically aluminum (for strength), coupled with heavy PVC breakers to attempt to isolate the aluminum from the cold interior air inside the refrigerator—they often use perimeter heater wires inside the doors to prevent external condensation.

Accordingly, it is an object of the invention to provide a swing door for a refrigerated cabinet having multiple-lites that prevents condensation from forming on the glazing.

It is another object of the invention to provide a swing door for a refrigerated cabinet that presents an aesthetically pleasing appearance.

It is another object of the invention to provide a swing door that can be adapted for a medium temperature cabinet or for a low temperature cabinet.

Briefly, the invention provides a door for a refrigerated cabinet having an insulated glass unit (IGU) of multi-lite construction with an inner glass lite of smaller size than an outer glass lite. In accordance with the invention, the outer glass lite has an opaque rectangularly shaped border on an inside surface that extends inwardly of inner glass lite to block from view any wires or the like used in the mounting of the door on a refrigerated cabinet The door also has a frame of aluminum encasing the IGU that is formed of interconnected horizontally disposed rails and vertically disposed rails (stiles) that are extruded.

In one embodiment, the vertical rails are shaped for accommodating a torsion rod closing system and top and bottom door couplings and the horizontal rails are of a different cross-sectional shape.

In another embodiment, the horizontal rails and vertical rails have the same basic cross-sectional shape for economies of fabrication.

The rails and stiles of the aluminum frame are sized and shaped to receive the insulated glass unit and the outer glass lite. The opaque border about the outer periphery of the outer glass lite serves to mask the mounting of the inner glass lite in the rails while providing ample see-through space to view the interior of the cabinet on which the door is mounted.

Each of the horizontally disposed rails and vertically disposed rails carries a PVC breaker or other suitable plastic or low-thermal-conductivity breaker that is snap-fitted onto a respective rail as well as a suitable magnetic bulb seal gasket or compression gasket that is snap-fitted into the breaker on a side of the insulated glass unit opposite the outer glass lite. When the door is mounted on a cabinet and moved into a closed position, the gaskets serve to seal against the cabinet.

In another embodiment, the rails of the door may be provided with a heater wire for heating the aluminum perimeter rails of the door and the perimeter of the glass lites of the IGU to avoid condensation from forming on the exterior surfaces of the aluminum or the glass perimeter.

The construction of the door provides an "all glass look" that allows "hiding" of ancillary structures, such as, torsion rod self-closing devices, top-and-bottom door hinge couplings, and wiring for perimeter heater wires and/or electrically heated glass, "inside" the door rail and 'behind" the outer lite of glass. Without a stepped IG, a much larger "external-to-the-glass" door profile would be required.

The stepped IG unit allows a border, in this case, a black ceramic frit ink border, to be permanently "fired onto" the back surface of the outer glass lite and to "hide" any insulating glass spacer system and other components behind this fully-opaque border. Because the border is printed on the back surface of the outer glass lite, an illusion of an all glass face or front on the door is provided.

Structurally speaking, the stepped IG unit provides greater gluing surfaces and gluing area, against which to seal the glass pack to the aluminum rails.

The stepped IG unit may be double-glazed or triple-glazed.

In one embodiment, using a triple glazed IG unit, the outer glass lite is provided with an electrically conductive coating on an inside surface facing an intermediate glass lite. In this embodiment, the aluminum rails define a frame about the insulated glass unit with each rail having the same cross-section. In addition, a plastic strip is disposed between the outer glass lite and each rail to electrically insulate the electrically conductive coating on the outer glass lite from the rail.

In addition, each rail is formed with a C-shaped cross-section to define a gap that acts as a thermal break between a cold side of a cabinet and a warm side to help prevent condensation from forming on the outside of the frame by "breaking" the path for heat transfer without having to use more expensive urethane-debridge technology. A plastic cover may also be snap-fitted into each rail to close the gap.

In order to warm the outer glass lite, electrically conductive bus bars are disposed along an upper edge and lower edge of inside surface of the outer glass lite and wires are passed through the rails to the bus bars to effect an electrical connection of a source of electrical power to the bus bars and, thus, to the electrically conductive coating on the inside of the outer glass lite. In this case, a non-conductive ceramic frit forms the opaque border on the outer glass lite and is disposed inside of the bus bars or in slightly overlapping relation.

These and other objects of the invention will become more apparent from the following detailed description taken in conjunction with the accompanying drawings in which.

Figure 1:
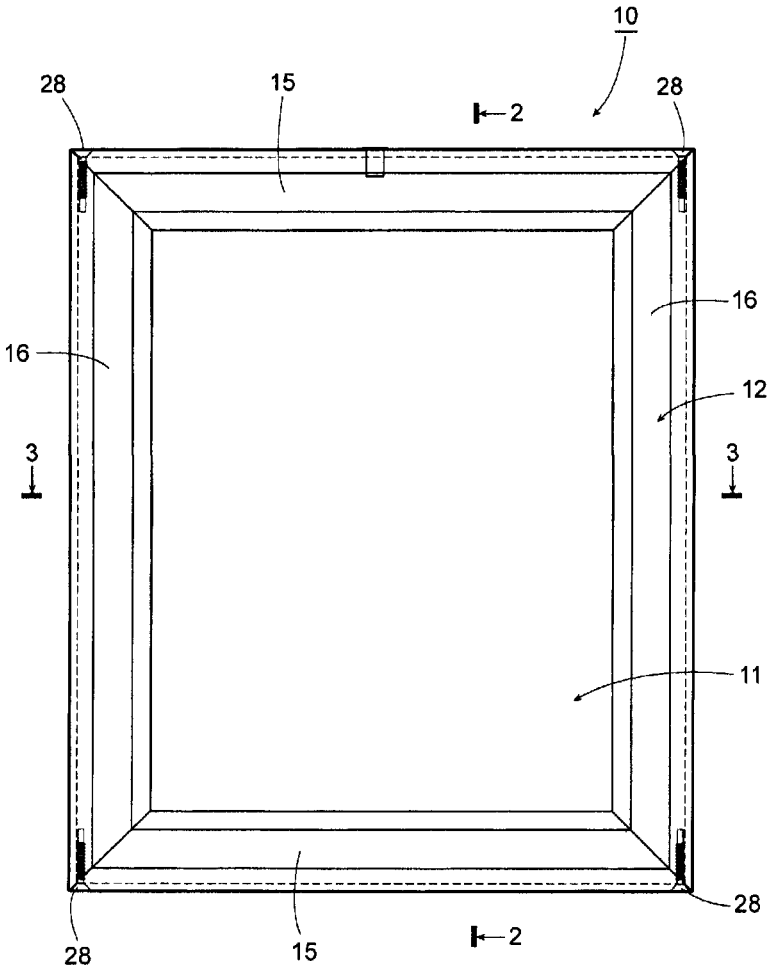
FIG. 1 illustrates a front view of a door constructed in accordance with the invention.

Referring to FIG. 1, the door 10 is constructed for use as a swing door on a cabinet, such as a refrigerated cabinet (not shown) or freezer cabinet (not shown).

The door 10 is of rectangular shape and is constructed of an insulated glass unit (IGU) 11 and a frame 12 of aluminum that encases the IGU 11.

Figure 2:
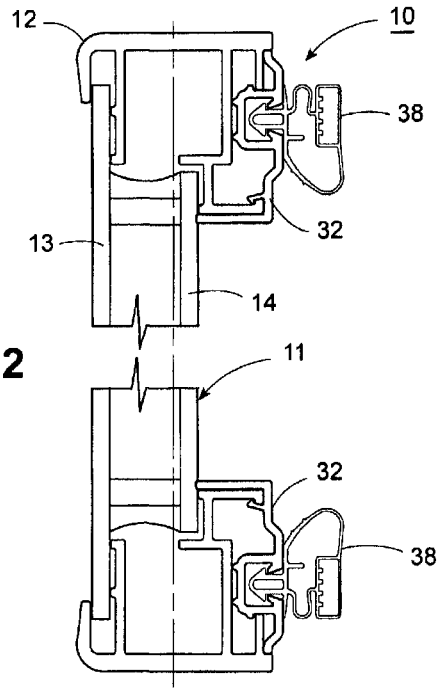
FIG. 2 illustrates a cross-section view taken on line 2-2 of FIG. 1.

Referring to FIG. 2, the IGU 11 has an outer glass lite 13 of predetermined rectangular shape and an inner glass lite 14 of smaller rectangular shape than the outer glass lite 13 and is sealingly secured to the outer glass lite 13 in spaced parallel relation to define a space therebetween. The IGU 11 is otherwise of conventional structure and need not be further described.

Referring to FIG. 1, the frame 12 is formed of four rails namely, a pair of horizontally disposed rails 15 and a pair of vertically disposed rails 16. The rails 15, 16 are made of extruded aluminum and have the same basic cross-section as described below.

Figure 4:
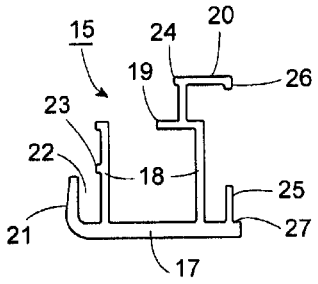
FIG. 4 illustrates a cross-sectional view of a horizontal rail of the door of FIG. 1.

Referring to FIG. 4, each horizontally disposed rail 15 has a base 17, a pair of parallel walls 18 extending perpendicularly of the base 17, a third wall 19 transverse to one of the pair of parallel walls 18, an abutment 20 extending from the third wall 19 for abutting the inner glass lite 14 (see FIG. 2), a flange 21 extending from the base 17 in parallel to the pair of walls 18 and defining a recess 22 with one of the walls 18 for receiving an edge of the outer glass lite 13 in sealed relation therein (see FIG. 2).

As illustrated, the wall opposite the flange 21 has a small rib 23 projecting into the recess 22 to abut the outer glass lite 13 so that the outer glass lite 13 is firmly held in place when the rail 15 is mounted thereon.

The abutment 20 is of L-shaped cross-section with a lip 24 for facing and abutting the inner glass lite 14 (see FIG. 2). The inner glass lite 14 is otherwise spaced a small distance from the transverse wall 19 and abutment 20 of the rail 15 to provide room for sealant that is used to hold the aluminum extrusions to the glass, and also to provide room for the aluminum to expand and contract without compressing the edge of the glass, which could cause glass breakage.

Each horizontally disposed rail 15 also has a second flange 25 extending from the base 17 in parallel to the pair of walls 18 on a side opposite the recess 22 in which the outer glass lite 13 is received. This flange 25 is co-planar with a lip 26 formed on the free end of the L-shaped abutment 20 and is spaced from the end of the base 17 to form a shoulder 27 therewith.

Referring to FIG. 1, each vertically disposed rail 16 is connected to and across the horizontally disposed rails 15 to define a frame. For example, a pair of threaded screws 28 passes through apertures (not shown) in each end of each horizontal rail 15 to threadably engage in a vertically disposed rail 16.

Figure 5:
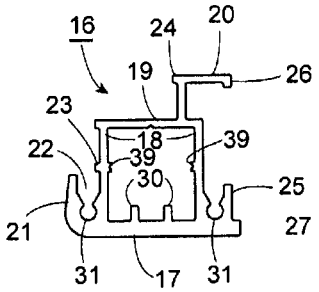
FIG. 5 illustrates a cross-sectional view of a vertical rail of the door of FIG. 1.

Referring to FIG. 5, wherein like reference characters indicate like parts as above, each vertically disposed rail 16 has a base 17, a pair of parallel walls 18 extending perpendicularly of the base 17, a third wall 19 transverse to the pair of parallel walls 18, an abutment 20 extending from the third wall 19 and abutting the inner glass lite 13, a flange 21 extending from the base 17 in parallel to the pair of walls 18 and defining a recess 22 with one of the walls 18 receiving an edge of the outer glass lite 12 in sealed relation therein.

As above, the wall opposite the flange 21 has a small rib 23 projecting into the recess 22 to abut the outer glass lite 13 and the abutment 20 has a lip 24 facing and abutting the inner glass lite 14.

Each vertically disposed rail 16 differs from a horizontally disposed rail 15 in having the transverse wall 19 extend between and be integral with each wall 18 of the pair of parallel walls 18 to define a closed space (hole) of rectangular (square) cross-section in order to add strength to the vertical rail. Each of the parallel walls 18 also has an inwardly directed bifurcated rib 29 while the base 17 has a pair of ribs 30 to capture and restrain from rotation top and bottom couplings (not shown) that insert into the square spaces that are fabricated into the hinge-side of the top and bottom horizontal aluminum rails. If the couplings are allowed to rotate, the couplings would wallow out the holes in the top and bottom rails, and eventually lead to a floppy door.

In addition, each vertically disposed rail 16 differs from a horizontally disposed rail 15 in that a circular recess 31 is formed between each of the flanges 21, 25 and the pair of parallel walls 18 in order to receive a threaded screw 28.

Figure 3:
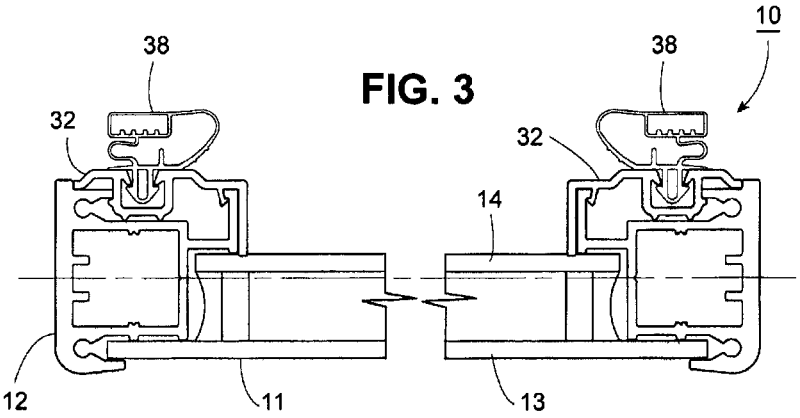
FIG. 3 illustrates a cross-section view taken on line 3-3 of FIG. 1.

Referring to FIGS. 2 and 3, each rail 15, 16 carries a breaker 32 of skeletal cross-section, for example being made of plastic, such as PVC.

Figure 6:
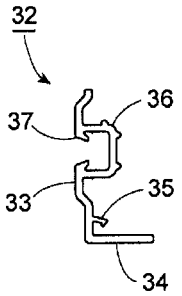
FIG. 6 illustrates a cross-sectional view of a breaker used in the door of FIG. 1.

Referring to FIG. 6, each breaker 32 has a main portion 33 that spans a rail 15, 16 from the shoulder 27 to the L-shaped abutment 20 and a leg 34 that abuts the backside of the L-shaped abutment 20. As illustrated, the breaker 32 has a small flange 35 parallel to the leg 34 to engage over the lip 26 on the L-shaped abutment 20 so that the breaker 32 is snap-fitted in place on the rail 15, 16.

The breaker 32 also has a block C-shaped recess 36 with a constricted mouth 37 in the main portion 33.

Referring to FIGS. 2 and 3, each breaker 32 carries a gasket 38 on a side of the IGU 11 opposite the outer glass lite 13.

Figure 7:
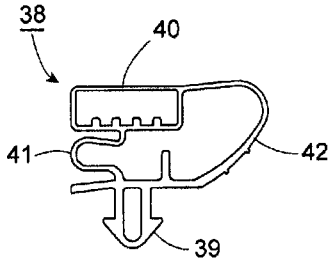
FIG. 7 illustrates a cross-sectional view of a gasket used in the door of FIG. 1.

As illustrated in FIG. 7, each gasket 38 has a bulb seal dart 39 on one side that is to be press-fitted into the block C-shaped recess 36 of PVC or other suitable plastic or low-thermally-conductive breaker 32. Each gasket 38 also includes a sealing surface and an internal soft extruded magnetic extrusion 40 that is mounted on flexible aprons 41 and 42 that are connected between and to the extruded magnet extrusion 40 and the bulb seal dart 39 at the base of the gasket 38.

Figure 8:
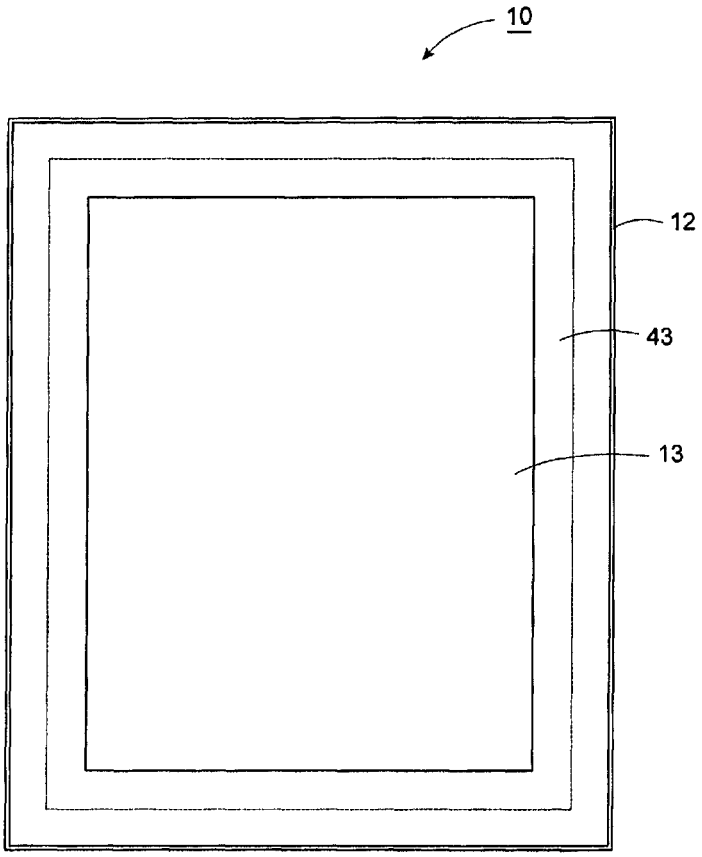
FIG. 8 illustrates a front view of a door with an opaque border in accordance with the invention.

Referring to FIG. 8, the outer glass lite 13 of the IGU 11 is provided with an opaque rectangularly shaped border 43 on the inside surface that extends inwardly of the inner glass lite 14 in order to mask the mounting of the inner glass lite in the rails 15, 16 as well as masking any ancillary structures, such as, torsion rod self-closing devices, top-and-bottom door hinge couplings, and wiring for perimeter heater wires and/or electrically heated glass, inside the door rail and behind the outer lite of glass The border 43 may be made of a black ceramic frit using a non-electrically-conductive ink.

In order to fabricate the door 10, the IGU 11 is positioned in a fixed position and each of the rails 15, 16 is fitted onto the sides of the IGU 11. Use is made of high-performance adhesive to adhere the IGU 11 to the rails 15, 16. Thereafter, the pairs of threaded screws 28 are threaded into place to secure the rails 15, 16 together.

Next, the breakers 32 are snap-fitted onto the aluminum rails 15, 16 and the magnetic bulb seal gaskets 38 are snapped into the breakers 32.

Figure 9:
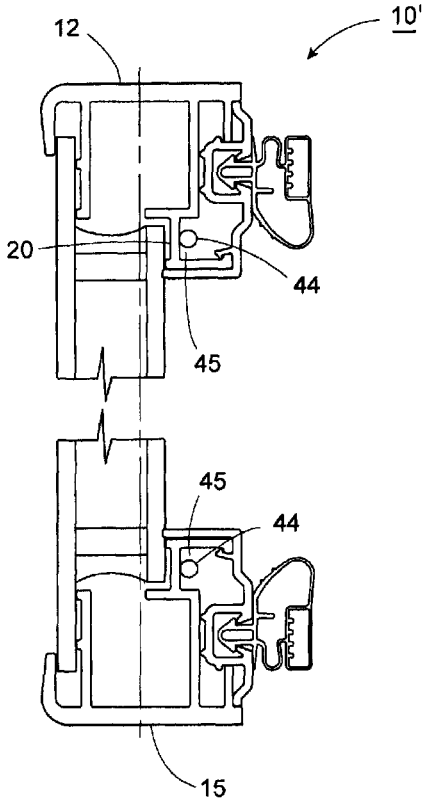
FIG. 9 illustrates a cross-sectional view similar to FIG. 2 of a vertical rail with a heater wire in accordance with the invention.

Referring to FIG. 9, wherein like reference characters indicate like parts as above, the door 10' may be provided with a heater wire 44 in order to heat the aluminum perimeter rails 15, 16 of the door 10 and the perimeter of the glass lites 13, 14 of the insulating glass unit 11 to avoid condensation from forming on the exterior surfaces of the aluminum rails or the glass perimeters. As illustrated, the wire 44 is placed in a recess 45 located on the L-shaped abutment 20 on a side opposite the inner glass lite 14 and is taped in place in contact with the aluminum rails 15, 16 using non-electrically-conductive tape (not shown) prior to snapping on the breakers 32, which further aids in holding the perimeter heater wire 44 in place. In this embodiment, the wire 44 extends through each of the four rails 15, 16 and is mounted in place before the breakers 32 are snapped into place. One of the vertically disposed rails 16 is also provided with an access opening (not shown) to allow the ends of the wire 44 to be connected to a suitable electrical source.

Where the door 10 is to be used as a swing door on a cabinet, one of the vertically disposed rails 16 is provided with a pocket (not shown) at each end to receive a suitable hinge construction. In addition, the upper horizontally disposed rail 15 is provided with a threaded recess to receive a shoulder bolt for securing an over-opening restraint of conventional structure in place for limiting an outward swing of the door from a cabinet. The restraint may also have a hold-open feature.

Figure 10:
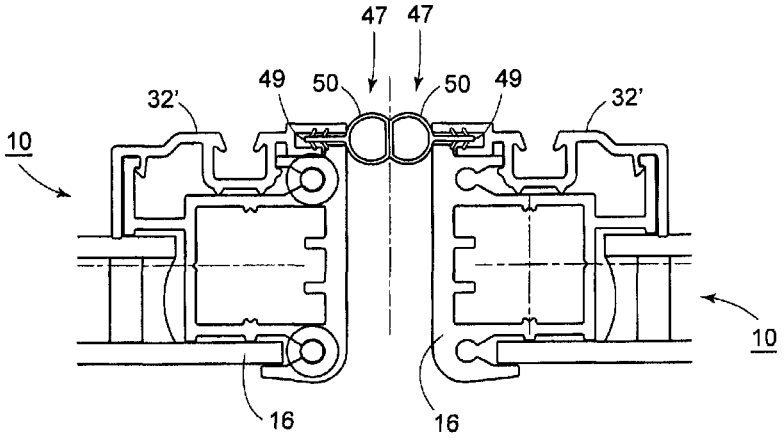
FIG. 10 illustrates a cross-sectional view of a door of FIG. 1 in sealed relation to an adjacent door in accordance with the invention.

Referring to FIG. 10, wherein like reference characters indicate like parts as above, the door 10 may be used on a cabinet to swing closed adjacent to and spaced laterally from an adjacent door 10 mounted in opposite-hand manner. As illustrated, the two doors 10 are spaced apart with a gasket 47 on each door 10 abutting against a similar gasket 47 on the other door 10. As illustrated, each gasket 47 is mounted in a breaker 32' snap-fitted into a vertical rail 16.

Figure 11:
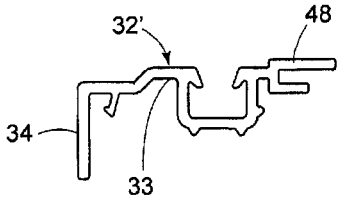
FIG. 11 illustrates a cross-sectional view of a modified breaker used in the doors of FIG. 10 for mounting a gasket.

Referring to FIG. 11, wherein like reference characters indicate like parts as above, each breaker 32' has a bifurcated projection 48 on an end of the main portion 33 opposite the leg 34 that defines a slot for receiving the gasket 47 (not shown).

As indicated in FIG. 10, each gasket 47 has a stem 49 slidably received in the slot of the breaker 32' and a bulb 50 that sealingly abuts the bulb 50 of the other gasket 47 in a resiliently deformed manner.

Figure 12:
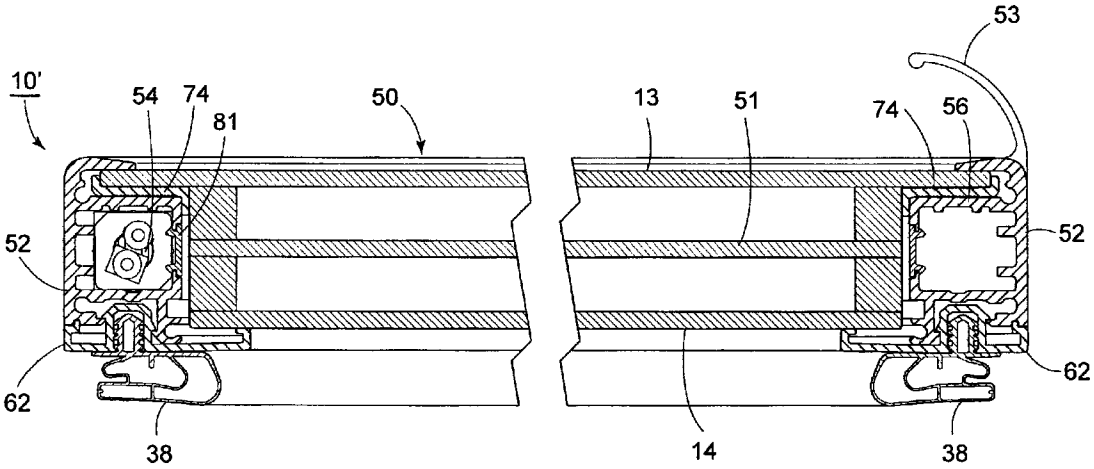
FIG. 12 illustrates a horizontal cross-sectional view of a door with a triple-glazed insulated glass unit in accordance with the invention.
Figure 13:
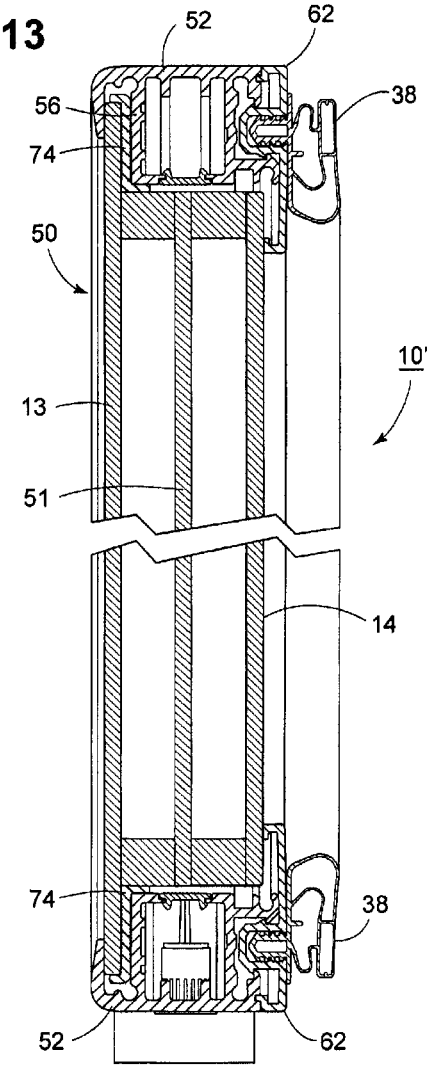
FIG. 13 illustrates a vertical cross-sectional view of a door with a triple-glazed insulated glass unit in accordance with the invention.

Referring to FIGS. 12 and 13, wherein like reference characters indicate like parts as above, the door 10' has a triple-glazed insulated glass unit 50 with an intermediate glass lite 51 between the outer glass lite 13 and inner glass lite 14. The intermediate lite 51 is of the same size as the inner lite 14 and the insulated glass unit 50 is otherwise of a conventional structure.

A frame of aluminum rails 52 is disposed about the insulated glass unit 50 with one of the vertical rails 52 having an integral curved handle 53 while the opposite rail 52 receives hinge elements 54 of known construction.

Figure 14:
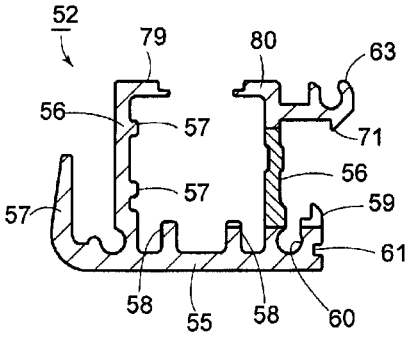
FIG. 14 illustrates a cross-sectional view of a rail used in the door of FIG. 12.

Referring to FIG. 14, each rail 52 has a base 55, a pair of parallel walls 56 extending perpendicularly of the base 55 and a flange 57 extending from the base in parallel to the pair of walls 56 and defining a recess with one of the walls 56 to receive an edge of the outer glass lite 13 in sealed relation as shown in FIGS. 12 and 13.

In addition, as above, each of the parallel walls 56 has inwardly directed ribs 57 while the base 55 has a pair of ribs 58 to capture and restrain from rotation top and bottom couplings (not shown) that insert into the square spaces that are fabricated into the hinge-side of the top and bottom horizontal aluminum rails 52. The hollows in the vertical rails 52 of the door 10' are of a size to accept self-closing devices and wire lead assemblies (not shown) that egress the door 10' through the hinge-side axis of rotation.

The base 55 of each rail 52 also has a flange 59 parallel to the walls 56 that forms a circular recess 60 at each end of the rail 52 to receive a threaded screw (not shown) for securing one rail 52 perpendicularly to an adjacent rail 52. The flange 59 also has a longitudinally extending groove 61 on an outside surface for receiving one end of a breaker 62 as shown in FIGS. 12 and 13.

Each rail 52 also has a C-shaped boss 63 mounted on and extending from one of the parallel walls 56 for receiving a heater wire (not shown) therein.

Figure 17:
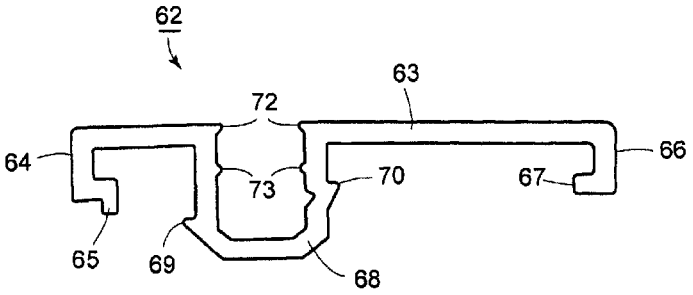
FIG. 17 illustrates a cross-sectional view of a breaker employed in the door of FIG. 12.

Referring to FIG. 17, each breaker 62 is of skeletal cross-section and is made of plastic, such as PVC, and is sized to fit along the length of a rail 52 to abut against the inner glass lite 14 and to retain the insulated glass unit 50 in place. Each breaker 62 has a main portion 63 that spans a rail 52, a leg 64 perpendicular to the main portion with a projecting foot 65 that fits into the groove 61 of a rail 52 and a leg 66 that has an inturned foot 67 that abuts the inner glass lite 14 (see FIG. 12).

Each breaker 62 also has a block C-shaped recess 68 in the main portion 63 with outstanding tabs 69, 70 on the opposite outside surfaces. As indicated in FIG. 12, the C-shaped recess 68 fits into a rail 52 between the flange 59 and the boss 63. In this respect, one tab 69 fits under the flange 59 and the other tab 70 fits under a lip 71 on the boss 63. The C-shaped recess 68 thus facilitates a snap-fitting of a breaker 62 in a rail 52.

Each C-shaped recess 68 has a constricted mouth defined by a pair of opposed lips 72 as well as a pair of opposed ribs 73 on inside walls of the recess 68.

Referring to FIG. 12, a plurality of gaskets 38 are used to seal the door 10 against a cabinet. As above, each gasket 38 is mounted in a breaker 62 on a rail 52 in a manner as described above.

Referring to FIG. 13, a plurality of plastic strips 74 (for example, PVC extrusions) are used to electrically insulate the electrically conductive coating on the outer glass lite 13 from the rails 52 of the frame. As illustrated, each plastic strip 74 is disposed between the outer glass lite 13 and a wall 56 of a rail 52 to electrically insulate the electrically conductive coating on the outer glass lite 13 from the wall 56.

Figure 16:
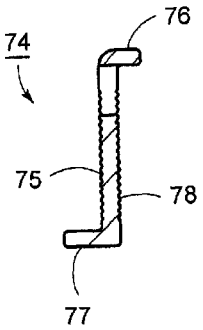
FIG. 16 illustrates a cross-sectional view of a plastic strip employed as insulation in the door of FIG. 12.

Referring to FIG. 16, each plastic strip 74 is of Z-shaped cross-section having a web 75 to be disposed in parallel against the outer glass lite 13, a first flange 76 to be disposed over an outer edge of outer glass lite 13 and a second flange 77 to be disposed over a respective rail 52. The web 73 has a corrugated surface 78 for facing the outer glass lite 13 for receiving a glue for bonding the web 75 to the outer glass lite 13.

Referring to FIG. 14, each rail 52 has a pair of walls 79, 80 extending from the ends of the walls 56 towards each other to define a gap therebetween while imparting a C-shaped cross-section to the rail 52. In addition, a plastic sash cover 81 (see FIG. 12) is fitted onto the walls 79, 80 to close the gap. These covers 81 may be made of PVC or other suitable plastic.

Figure 15:
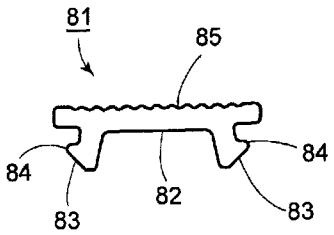
FIG. 15 illustrates a cross-sectional view of a sash cover employed in the door of FIG. 12.

Referring to FIG. 15, each sash cover 81 has a base 82 with a pair of outwardly extending legs 83, each of which has an outwardly extending foot 84 at the end. In addition, the base 82 has a corrugated surface 85 for facing the intermediate glass lite 51 of the insulated glass unit 50

Each cover 81 extends over the length of a rail 52 and is snap-fitted via the resilient legs 83 into the gap between the walls 79, 80 of a rail 52. The corrugated surface 85 of the cover 81 provides an increased glueing surface between a rail 52 and a side of the insulated glass unit 50. This also provides a place to pack some sealant to hold the insulated glass unit 50 to the rails 52.

Figure 18:
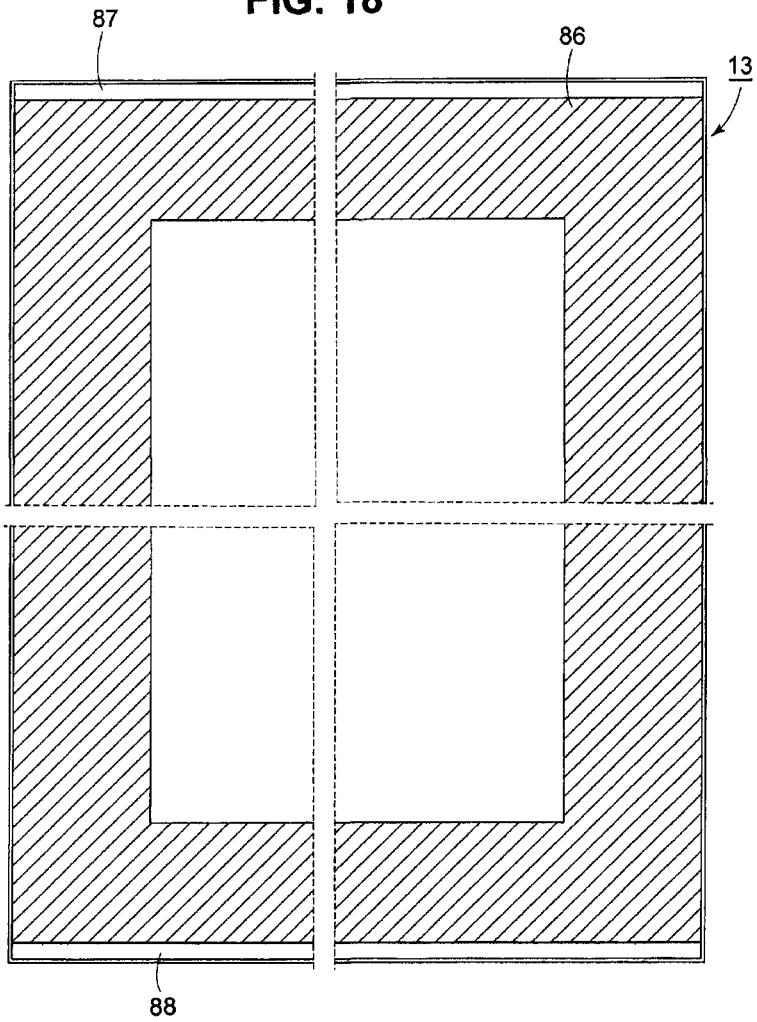
FIG. 18 illustrates a rear view of the outer glass lite of the insulated glass unit of FIG. 12.

Referring to FIG. 18, an opaque non-conductive ceramic frit 86 is provided on an inside surface of the outer glass lite 13 to form a rectangularly shaped border for facing the intermediate glass lite. In addition, an electrically conductive bus bar 87 is disposed along an upper edge of the inside surface of the outer glass lite 13 and an electrically conductive bus bar 88 is disposed along a lower edge of the inside surface of the outer glass lite 13.

Assembly of the insulated glass unit 50 into the door 10' is as follows.

In fabricating the insulated glass unit 50, the outer glass lite 13 which is an electrically conductive coated glass is provided with silver ceramic frit bus bars 87, 88 at the very edges of the glass lite that are tempered into the coated glass surface. The silver ceramic frit bars 87, 88 can be soldered as opposed to silver polymer bus bars which cannot be soldered.

Just inside the silver bus bars 87,88 (and perhaps even touching them or even overlapping them slightly), the black ceramic frit ink border 86 (FIG. 18) is printed on the inside surface of the glass lite 13. Alternatively, the border 86 may be formed by an UV-cure or even polymer ink. However, the ceramic frit ink is much more durable and is impervious to attack from glues, adhesives, tapes, and the like, because the ceramic frit ink is "fired on" during tempering. In addition, ceramic frit inks will expand and contract consistently with the underlying glass lite 13 and coated surface on the glass.

Once the IGU 50 has been assembled, the Z-shaped plastic strips 74 (FIG. 16) are miter cut and glued over top of the full-perimeter of the inside surface of the outer glass lite 13. These plastic strips 74 will thus function as the electrical insulation between the conductive surface of the outer glass lite 13 and the conductive aluminum rails 52.

Prior to gluing the Z-shaped insulation strips 74 to the outer glass lite 13, a hole (not shown) of square, round or oval shape is punched in each of the horizontal insulation strips 74 in a position to be directly over top of the silver ceramic frit bus bars 87, 88 near the hinge-side of the door in order to gain access to the bus bars for soldering a clip, such as an AMP connector type spade connector or a wire lead directly to the silver ceramic frit bus bar.

The aluminum rails 52 are milled or punched to provide a larger-sized access port directly over top of the smaller access port in the underlying PVC insulation strip 74. This allows access for installing the necessary wire leads to the bus bars to energize the electrically conductive coating of the outer glass lite 13.

During assembly, the small interior PVC covers 81 (FIG. 15) are snapped into the rails 52 to provide glueing caps over top of the rails 52 with the corrugated surfaces 86 providing more gluing surface area between the open "C" rails 52 and the sides of the stepped IG unit 11.

Each aluminum rail 52 is then installed over top of the PVC-encased (insulated) outer lite 13 of the IG unit 50 to complete the door 10'.

The completed door 10' thus has a stepped IG unit 50 that has the ability to be energized on the inside surface of the outer glass lite 13 thus allowing the heated glass to warm the aluminum rails 52 all the way to the edge of the glass in such a way that may totally obsolete a need for a perimeter wire 44 (see FIG. 9).

The door 10' is particularly useful on a low temperature cabinet. In the event that the door 10' is to be used on a medium temperature cabinet, the triple glazed IG unit 50 is replaced by the double glazed IG unit 11 and the breakers 62 are replaced by the breakers (not shown) having a longer leg 34 as the breaker 32 of FIG. 6 to abut the inner glass lite 14

The invention thus provides a swing door for a refrigerated cabinet having multiple-lites that prevents condensation from forming on the glazing and that presents an aesthetically pleasing appearance.

The invention also provides a swing door that can be constructed for a medium temperature cabinet or for a low temperature cabinet.

What is claimed is:

1. A door for a refrigerated cabinet comprising an insulated glass unit having an outer glass lite of predetermined rectangular shape with an electrically conductive coating thereon, an inner glass lite of smaller rectangular shape than said outer glass lite and an intermediate glass lite disposed in spaced relation between said outer glass lite and said inner glass lite;

a plurality of aluminum rails defining a frame about said insulated glass unit, each said rail having a base, a pair of parallel walls extending perpendicularly of said base and a flange extending from said base in parallel to said pair of walls and defining a recess with one of said walls receiving an edge of said outer glass lite in sealed relation therein; and a plurality of plastic strips, each said plastic strip being disposed between said outer glass lite and one of said pair of parallel walls of a respective rail to electrically insulate said electrically conductive coating on said outer glass lite from said one of said pair of parallel walls of said respective rail.

2. A door as set forth in claim 1 wherein each said plastic strip is of Z-shaped cross-section having a web disposed in parallel against said outer glass lite, a first flange disposed over an outer edge of said outer glass lite and a second flange disposed over a respective rail.

3. A door as set forth in claim 2 wherein said web of each said plastic strip has a corrugated surface facing said outer glass lite for receiving a glue for bonding said web to said outer glass lite and a corrugated surface facing said respective rail.

4. A door as set forth in claim 1 further comprising a plurality of plastic breakers, each said breaker being snap-fitted onto a respective one of said rails and having an end disposed in abutment with said inner glass lite.

5. A door as set forth in claim 4 further comprising a plurality of gaskets, each said gasket having a grommet thereon and wherein each said breaker is of skeletal structure including a cup-shaped recess having a constricted mouth receiving said grommet of a respective gasket in snap-fit relation.

6. A door as set forth in claim 1 wherein each said rail includes a third wall extending from one of said pair of walls towards the other of said pair of walls and a fourth wall extending from said other of said pair of walls towards said third wall to define a gap therebetween and imparting a C-chaped cross-section to said rail.

7. A door as set forth in claim 6 further comprising a plurality of plastic covers, each said cover being fitted onto said third wall and said fourth wall of a respective rail to close said gap therebetween.

8. A door as set forth in claim 7 wherein each said cover has a corrugated surface facing said intermediate glass lite of said insulated glass unit.

9. A door as set forth in claim 1 further comprising an opaque non-conductive ceramic frit forming a rectangularly shaped border on an inside surface of said outer glass lite facing said intermediate glass lite, an electrically conductive bus bar disposed along an upper edge of said inside surface of said outer glass lite and an electrically conductive bus bar disposed along a lower edge of said inside surface of said outer glass lite.

10. A door as set forth in claim 1 wherein each said rail includes a C-shaped boss mounted on and extending from one of said walls of said pair of parallel walls for receiving a heater wire therein.

* * * * *